US011232757B2

(12) United States Patent
Lin

(10) Patent No.: US 11,232,757 B2
(45) Date of Patent: Jan. 25, 2022

(54) BACKLIGHT CONTROL METHOD AND DEVICE, AND COMPUTER-READABLE STORAGE MEDIUM FOR IMPROVING THE CONTRAST, RESTORING THE IMAGE, AND ENSURING THE DISTORTION OF THE IMAGE

(71) Applicant: SHENZHEN SKYWORTH-RGB ELECTRONIC CO., LTD., Shenzhen (CN)

(72) Inventor: Yilin Lin, Shenzhen (CN)

(73) Assignee: SHENZHEN SKYWORTH-RGB ELECTRONIC CO., LTD., Shenzhen (CN)

( * ) Notice: Subject to any disclaimer, the term of this patent is extended or adjusted under 35 U.S.C. 154(b) by 0 days.

(21) Appl. No.: 17/001,858

(22) Filed: Aug. 25, 2020

(65) Prior Publication Data

US 2020/0388232 A1 Dec. 10, 2020

Related U.S. Application Data

(63) Continuation of application No. PCT/CN2018/120347, filed on Dec. 11, 2018.

(30) Foreign Application Priority Data

Mar. 27, 2018 (CN) ..... 201810257193.7

(51) Int. Cl.
*G09G 3/34* (2006.01)
*G09G 3/36* (2006.01)

(52) U.S. Cl.
CPC ..... *G09G 3/3406* (2013.01); *G09G 3/36* (2013.01); *G09G 2320/066* (2013.01); *G09G 2360/16* (2013.01)

(58) Field of Classification Search
CPC ..... G09G 3/22; G09G 3/34; G09G 3/3406; G09G 3/3413; G09G 3/342; G09G 3/3426;
(Continued)

(56) References Cited

U.S. PATENT DOCUMENTS 7,046,288 B1 5/2006 Finlayson
10,002,567 B2 6/2018 Uchino et al.
(Continued)

FOREIGN PATENT DOCUMENTS

CN 1705001 A 12/2005
CN 101021944 A 8/2007
(Continued)

OTHER PUBLICATIONS

Third Office Action in counterpart Chinese Application No. 201810257193.7, dated Oct. 10, 2020.
(Continued)

*Primary Examiner* — Keith L Crawley
(74) *Attorney, Agent, or Firm* — Westbridge IP LLC

(57) ABSTRACT

Disclosed are a backlight control method, a backlight control device and a computer-readable storage medium. The backlight control method includes the following steps: acquiring each pixel of each area in an image; calculating a first backlight value based on the pixel, threshold-limiting the first backlight value, and obtaining a second backlight value subjected to threshold-limiting and a third backlight value without threshold-limiting; and sending the second backlight value to a backlight control circuit, performing backlight compensation on the image based on the third backlight value, and sending the image after backlight compensation to a liquid crystal display screen. The backlight control method calculates a backlight value to perform backlight compensation on the image, and adjusts the liquid
(Continued)

crystal cells of the liquid crystal display screen, thereby improving the contrast and ensuring the distortion of the image, and the algorithm is simple.

14 Claims, 4 Drawing Sheets

(58) Field of Classification Search
CPC ..... G09G 3/36; G09G 2320/02; G09G 2320/0233; G09G 2320/06; G09G 2320/0613; G09G 2320/062; G09G 2320/0646; G09G 2320/066; G09G 2360/16
See application file for complete search history.

(56) References Cited

U.S. PATENT DOCUMENTS

2012/0281028 A1* 11/2012 Orlick ..... G09G 3/3426 345/690
2013/0265337 A1* 10/2013 Furumoto ..... G09G 5/10 345/690
2014/0204131 A1* 7/2014 Chen ..... G09G 3/3406 345/691
2015/0049129 A1* 2/2015 Ooga ..... G09G 3/3406 345/690
2015/0365621 A1* 12/2015 Zhang ..... G09G 5/005 348/791
2016/0335957 A1* 11/2016 Fu ..... G09G 3/36
2017/0018231 A1* 1/2017 Liu ..... G09G 3/3426
2017/0039967 A1* 2/2017 Jung ..... G06T 5/40
2017/0061897 A1* 3/2017 Zhang ..... G09G 3/3426
2017/0061901 A1* 3/2017 Zhang ..... G09G 3/3426
2018/0075813 A1* 3/2018 Zhang ..... G09G 3/34
2018/0090076 A1* 3/2018 Zhang ..... G09G 3/3426
2018/0247609 A1* 8/2018 Joshi ..... G09G 3/3426
2019/0304379 A1* 10/2019 Pytlarz ..... G09G 3/3406

FOREIGN PATENT DOCUMENTS

CN 101866638 A 10/2010
CN 102097068 A 6/2011
CN 102903340 A 1/2013
CN 105047140 A 11/2015
CN 105139809 A 12/2015
CN 105719608 A 6/2016
CN 105788562 A 7/2016
CN 106228935 A 12/2016
CN 107342054 A 11/2017
CN 107689215 A 2/2018
CN 108389553 A 8/2018

OTHER PUBLICATIONS

First Office Action in counterpart Chinese Application No. 201810257193.7, dated Jun. 19, 2019.
International Search Report in corresponding PCT Application No. PCT/CN2018/120347, dated Mar. 20, 2019.
Second Office Action in counterpart Chinese Application No. 201810257193.7, dated Jan. 15, 2020.

* cited by examiner

BACKLIGHT CONTROL METHOD AND DEVICE, AND COMPUTER-READABLE STORAGE MEDIUM FOR IMPROVING THE CONTRAST, RESTORING THE IMAGE, AND ENSURING THE DISTORTION OF THE IMAGE

CROSS REFERENCE TO RELATED APPLICATIONS

The present disclosure is a Continuation Application of PCT Application No. PCT/CN2018/120347, filed on Dec. 11, 2018, which claims the priority of Chinese Patent Application No. 201810257193.7, entitled "Backlight Control Method And Device, And Computer-Readable Storage Medium", filed on Mar. 27, 2018, which is hereby incorporated by reference in its entirety.

FIELD

The present application relates to the technical field of liquid crystal display screens, in particular to a backlight control method, a backlight control device, and a computer-readable storage medium.

BACKGROUND

Nowadays, LCD screens have become the mainstream technology of flat panel displays due to their low power consumption, light weight, thin thickness, and gorgeous color display. They are widely used in our daily electronic products, such as laptops, mobile phones, GPS, home TV, etc. Since the LCD screen itself does not emit light by itself, a backlight is needed to be set behind the projection type LCD panel, and then the effect of the video image is modulated through the probability of the transmitted light through the LED liquid crystal cell, so as to achieve the desired display images of dynamic scenes. At present, because of the advantages of low power consumption, long life, environmental protection, and strong controllability, the light-emitting diode backlight of the liquid crystal display has gradually replaced the traditional cold-light cathode tube backlight. It is essential to overcome and improve the inherent nature of the liquid crystal display to ensure the quality of the picture.

At present, the backlight control method of the liquid crystal display in the prior art determines the backlight degree through the maximum value algorithm, the average value algorithm, and the square root algorithm, while the maximum value algorithm has regional optical crosstalk, which causes image distortion in some areas; the backlight degree determined by the average value algorithm will cause the image to be darker for the entire image; and the square root algorithm will cause the backlight brightness after the light compensation in the dark scene area to be too high, causing picture distortion. Therefore, the current backlight control method cannot guarantee the image contrast and distortion at the same time, and the algorithm is complicated.

The above content is only used to help understand the technical solution of the present application, and does not mean that the above content is recognized as prior art.

SUMMARY

The main object of the present application is to provide a backlight control method, which aims to solve the technical problem that the existing backlight control method cannot guarantee the image contrast and distortion at the same time.

To achieve the above object, the present application provides a backlight control method, which includes:

acquiring each pixel of each area in an image;

calculating a first backlight value based on the pixel, threshold-limiting the first backlight value, and obtaining a second backlight value subjected to threshold-limiting and a third backlight value without threshold-limiting; and sending the second backlight value to a backlight control circuit, performing backlight compensation on the image based on the third backlight value, and sending the image after backlight compensation to a liquid crystal display screen.

Optionally, the step of calculating a first backlight value based on the pixel includes:

calculating a grayscale value of each pixel by using a maximum value algorithm;

calculating an average grayscale value by using an average value algorithm based on the grayscale value; and correcting backlight of an entire area based on a backlight correction function, and obtaining the first backlight value.

Optionally, the step of threshold-limiting the first backlight value, and obtaining a second backlight value subjected to threshold-limiting and a third backlight value without threshold-limiting includes:

determining whether the first backlight value includes a backlight value less than a preset threshold;

in a determination that the first backlight value includes the backlight value less than the preset threshold, taking the backlight value less than the preset threshold as the second backlight value; and taking a backlight value not less than the preset threshold as the third backlight value.

Optionally, the step of performing backlight compensation on the image based on the third backlight value includes:

calculating an average value of the third backlight value and a variance of the third backlight value by using a first preset formula; and calculating a backlight compensation value based on the average value and the variance, and performing backlight compensation on the image based on the backlight compensation value.

Optionally, the step of calculating a backlight compensation value based on the average value and the variance includes:

determining whether the average value is less than a preset average value threshold and/or the variance is less than a preset variance threshold; and in a determination that the average value is less than the preset average value threshold and/or the variance is less than the preset variance threshold, calculating the backlight compensation value based on a second preset formula.

Optionally, subsequent to the step of determining whether the average value is less than a preset average value threshold and/or the variance is less than a preset variance threshold, the backlight control method further includes:

in a determination that the average value is not less than the preset average value threshold and the variance is not less than the preset variance threshold, performing no backlight compensation.

Optionally, subsequent to the step of in a determination that the average value is less than the preset average value threshold and/or the variance is less than the preset variance threshold, calculating the backlight compensation value based on a second preset formula, the backlight control method further includes:

threshold-limiting the backlight compensation value by using a third preset formula, and obtaining a final backlight compensation value; and performing backlight compensation on the image based on the final backlight compensation value.

Optionally, subsequent to the step of sending the second backlight value to a backlight control circuit, performing backlight compensation on the image based on the third backlight value, and sending the image after backlight compensation to a liquid crystal display screen, the backlight compensation method further includes:

acquiring pixel values of all pixels in the image after backlight compensation;

determining a brightness area and a darkness area based on the pixel values;

opening a liquid crystal cell in a cell of the brightness area; and turning off or reducing a voltage of a cell of the darkness area.

In addition, in order to achieve the above object, the present application further provides a backlight control device, which includes: a memory, a processor, and a backlight control program stored on the memory and operable on the processor, the backlight control program, when executed by the processor, implements the steps of the above mentioned backlight control method.

In addition, in order to achieve the above object, the present application further provides a computer-readable storage medium, a backlight control program is stored on the computer-readable storage medium, the backlight control program, when executed by a processor, implements the steps of the above mentioned backlight control method.

The present application provides a backlight control method, a backlight control device, and a computer-readable storage medium. Each pixel of each area in an image is acquired, a first backlight value is calculated based on the pixel, the first backlight value is threshold-limited to obtain a second backlight value subjected to threshold-limiting and a third backlight value without threshold-limiting, and finally the second backlight value is sent to the backlight control circuit, the image is subjected to backlight compensation based on the third backlight value, and the image after backlight compensation is sent to the LCD screen. In this way, the image is subjected to backlight compensation by the calculation of the backlight value, and the liquid crystal cells of the LCD screen are adjusted, thereby improving the contrast, restoring the image well, and ensuring the distortion of the image, and the algorithm is simple.

The implementation, functional characteristics and advantages of the present application will be further described in conjunction with the embodiments and with reference to the drawings.

DETAILED DESCRIPTION OF THE EMBODIMENTS

It should be understood that the specific embodiments described herein are only used to explain the present application, and are not used to limit the present application.

Figure 1:
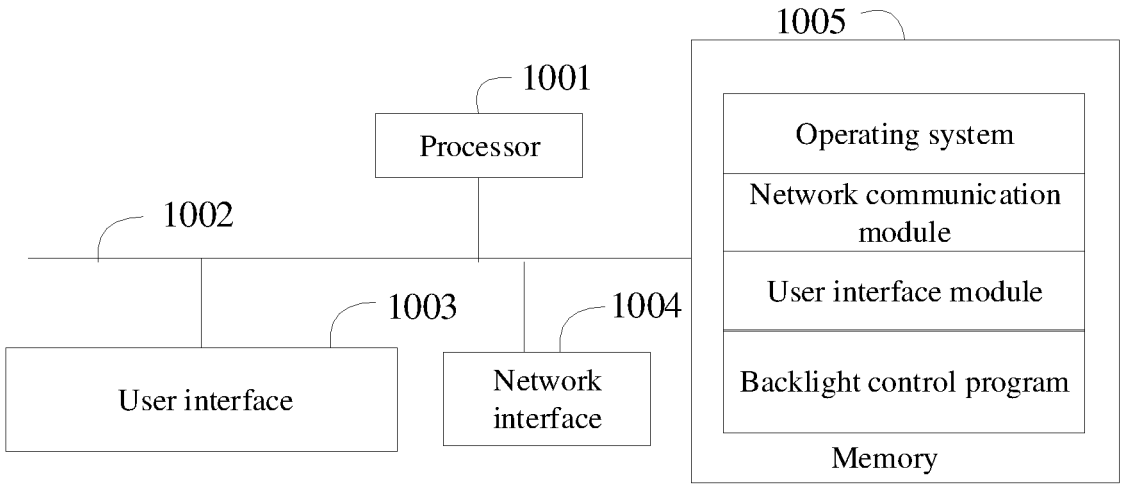
FIG. 1 is a schematic structural diagram of a terminal to which a backlight control device belongs in a hardware operating environment according to an embodiment of the present application.

As shown in FIG. 1, FIG. 1 is a schematic structural diagram of a terminal to which a backlight control device belongs in a hardware operating environment according to an embodiment of the present application.

In this embodiment of the present application, the terminal may be a PC. As shown in FIG. 1, the terminal may include: a processor 1001, such as a CPU, a network interface 1004, a user interface 1003, a memory 1005, and a communication bus 1002. The communication bus 1002 is configured to implement connection communication between these components. The user interface 1003 may include a display, an input unit such as a keyboard, and optionally the user interface 1003 may further include a standard wired interface and a wireless interface. The network interface 1004 may optionally include a standard wired interface and a wireless interface (such as a WI-FI interface). The memory 1005 may be a high-speed RAM memory or a stable memory (non-volatile memory), such as a disk memory. The memory 1005 may optionally be a storage device independent of the foregoing processor 1001.

Optionally, the terminal may further include a camera, an RF (Radio Frequency) circuit, a sensor, an audio circuit, a WiFi module, and so on. Sensors may be light sensors, motion sensors and other sensors. Specifically, the light sensor may include an ambient light sensor and a proximity sensor, where the ambient light sensor may adjust the brightness of the display screen according to the brightness of the ambient light, and the proximity sensor may turn off the display screen and/or the backlight when the mobile terminal moves to the ear. As a kind of motion sensor, the gravity acceleration sensor may detect the magnitude of acceleration in the direction (generally three axes), and may detect the magnitude and direction of gravity when at rest, and may be configured to identify the posture of mobile terminals (such as horizontal and vertical screen switching, related games, magnetometer attitude calibration), vibration recognition related functions (such as pedometer, tap), etc. Certainly, the mobile terminal may further be configured with other sensors such as gyroscopes, barometers, hygrometers, thermometers, infrared sensors, etc. which will not be repeated here.

Those skilled in the art may understand that the terminal structure shown in FIG. 1 does not constitute a limitation on the terminal, and more or fewer components than those illustrated may be included, or certain components may be combined, or different components may be arranged.

As shown in FIG. 1, the memory 1005 as a computer storage medium may include an operation server, a network communication module, a user interface module, and a program.

In the terminal shown in FIG. 1, the network interface 1004 is mainly configured to connect to the back-end server and perform data communication with the back-end server; the user interface 1003 is mainly configured to connect to the client (user end) and perform data communication with the client; and the processor 1001 may be configured to call a program stored in the memory 1005.

In this embodiment, the device includes: a memory 1005, a processor 1001, and a program stored on the memory 1005 and executable on the processor 1001, where the processor 1001 calls the program stored in the memory 1005 to implement the following steps:

acquiring each pixel of each area in an image;

calculating a first backlight value based on the pixel, threshold-limiting the first backlight value, and obtaining a second backlight value subjected to threshold-limiting and a third backlight value without threshold-limiting; and sending the second backlight value to a backlight control circuit, performing backlight compensation on the image based on the third backlight value, and sending the image after backlight compensation to a liquid crystal display screen.

Further, the processor 1001 may call the backlight control program stored in the memory 1005 to further implement the following steps:

calculating a grayscale value of each pixel by using a maximum value algorithm;

calculating an average grayscale value by using an average value algorithm based on the grayscale value; and correcting backlight of an entire area based on a backlight correction function, and obtaining the first backlight value.

Further, the processor 1001 may call the backlight control program stored in the memory 1005 to further implement the following steps:

determining whether the first backlight value includes a backlight value less than a preset threshold;

in a determination that the first backlight value includes the backlight value less than the preset threshold, taking the backlight value less than the preset threshold as the third backlight value; and taking a backlight value not less than the preset threshold as the third backlight value.

Further, the processor 1001 may call the backlight control program stored in the memory 1005 to further implement the following steps:

calculating an average value of the third backlight value and a variance of the third backlight value by using a first preset formula; and calculating a backlight compensation value based on the average value and the variance, and performing backlight compensation on the image based on the backlight compensation value.

Further, the processor 1001 may call the backlight control program stored in the memory 1005 to further implement the following steps:

determining whether the average value is less than a preset average value threshold and/or the variance is less than a preset variance threshold; and in a determination that the average value is less than the preset average value threshold and/or the variance is less than the preset variance threshold, calculating the backlight compensation value based on a second preset formula.

Further, the processor 1001 may call the backlight control program stored in the memory 1005 to further implement the following steps:

in a determination that the average value is not less than the preset average value threshold and the variance is not less than the preset variance threshold, performing no backlight compensation.

Further, the processor 1001 may call the backlight control program stored in the memory 1005 to further implement the following steps:

threshold-limiting the backlight compensation value by using a third preset formula, and obtaining a final backlight compensation value; and performing backlight compensation on the image based on the final backlight compensation value.

Further, the processor 1001 may call the backlight control program stored in the memory 1005 to further implement the following steps:

acquiring pixel values of all pixels in the image after backlight compensation;

determining a brightness area and a darkness area based on the pixel values;

opening a liquid crystal cell in a cell of the brightness area; and turning off or reducing a voltage of a cell of the darkness area.

The present application further provides a backlight control method.

Figure 2:
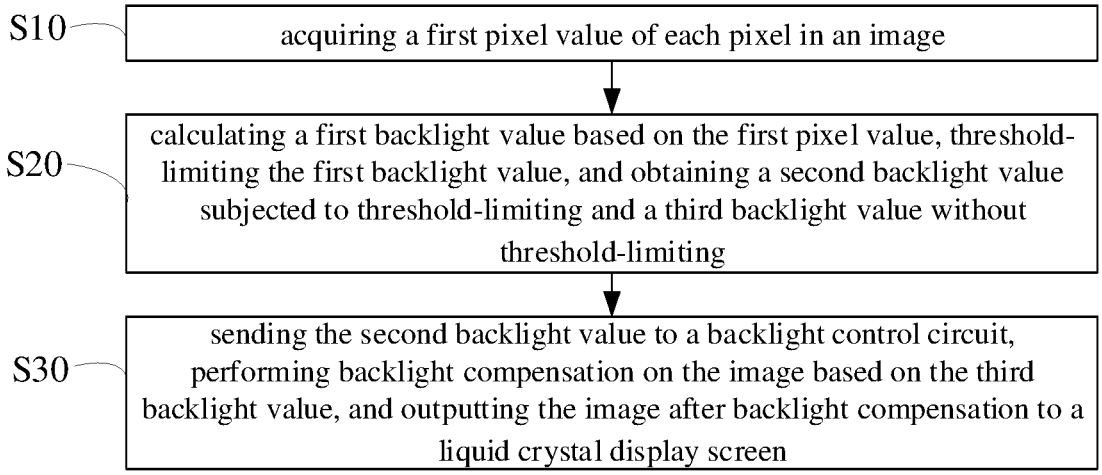
FIG. 2 is a schematic flowchart according to a first embodiment of a backlight control method of this application.

Referring to FIG. 2, FIG. 2 is a schematic flowchart according to a first embodiment of a backlight control method of this application.

In this embodiment, the backlight control method includes:

Step S10: acquiring a first pixel value of each pixel in an image.

In this embodiment, the technician divides the image into multiple areas according to actual needs, and pixels in each area are acquired, where the value of the pixel indicates the brightness of the image at that pixel.

Step S20: calculating a first backlight value based on the first pixel value, threshold-limiting the first backlight value, and obtaining a second backlight value subjected to threshold-limiting and a third backlight value without threshold-limiting.

In this embodiment, a maximum RGB value in all pixels is calculated by using a maximum value algorithm, and the maximum RGB value is taken as a grayscale value of the pixel, and an average grayscale value is calculated by using an average value algorithm. Specifically, firstly a sum of corresponding grayscale values of all pixels is calculated, and then the sum of the grayscale values is divided by a number of pixels to obtain an average grayscale value. The first backlight value is calculated according to a formula set by a technician. The formula may be $BL'(i)=Local_{avg}+f(Local_{avg}, Local_{max})$, where BL'(i) is first backlight value, $Local_{avg}$ is average grayscale value, $Local_{max}$ is pixel grayscale value, and $f(Local_{avg}, Local_{max})$ is backlight correction function. The backlight of the entire area is corrected by the backlight correction function. When $Local_{avg}$ is small, it means that the entire area is in a dark scene area, the brightness is small, and the correction value increases less. When $Local_{avg}$ is large, it means that the entire area is in the bright scene area, the brightness is large, and the correction value increases more.

Further, when the brightness reaches a certain value, the human eye is not highly sensitive to it, so the first backlight value may be backlight-limited by using a set formula $BL(i)=\min(BL_{max}, BL'(i))$, where $BL_{max}$ is set threshold, and a second backlight value subjected to threshold-limiting and a third backlight value without threshold-limiting are obtained by the set formula. The second backlight value subjected to threshold-limiting refers to a backlight value not less than the threshold in the first backlight value, and the third backlight value refers to a backlight value less than the threshold in the first backlight value. The threshold may be set by a technician according to experiment and actual conditions.

Step S30: sending the second backlight value to a backlight control circuit, performing backlight compensation on the image based on the third backlight value, and outputting the image after backlight compensation to a liquid crystal display screen.

In this embodiment, the second backlight value is a backlight value subjected to threshold-limiting, and the third backlight value is a backlight value without threshold-limiting. The backlight value subjected to threshold-limiting is sent to a backlight control circuit, and the backlight value without threshold-limiting is sent to a calculation module for calculating the backlight compensation value. Specifically, the average value and the variance of the backlight value without threshold-limiting are calculated, and then it is determined whether the calculated average value and variance meet the corresponding threshold condition. If the corresponding threshold condition is met, the backlight compensation value is obtained by using a preset function. If the corresponding threshold condition is not met, the default backlight compensation value is 1, indicating that no compensation is performed on the image and the image data is sent to the LCD screen.

Further, a threshold may be set for threshold-limiting the obtained backlight compensation value to obtain a final backlight compensation value, and the final compensation value is sent to the backlight compensation module to perform backlight compensation on the image.

In the backlight control method according to the present embodiment, each pixel of each area in an image is acquired, a first backlight value is calculated based on the pixel, the first backlight value is threshold-limited to obtain a second backlight value subjected to threshold-limiting and a third backlight value without threshold-limiting, and finally the second backlight value is sent to the backlight control circuit, the image is subjected to backlight compensation based on the third backlight value, and the image after backlight compensation is output to the LCD screen. In this way, the backlight compensation of the image is realized by the calculation of the backlight value, and the liquid crystal cells of the LCD screen are adjusted, thereby improving the contrast, restoring the image well, and ensuring the distortion of the image, and the algorithm is simple.

Figure 3:
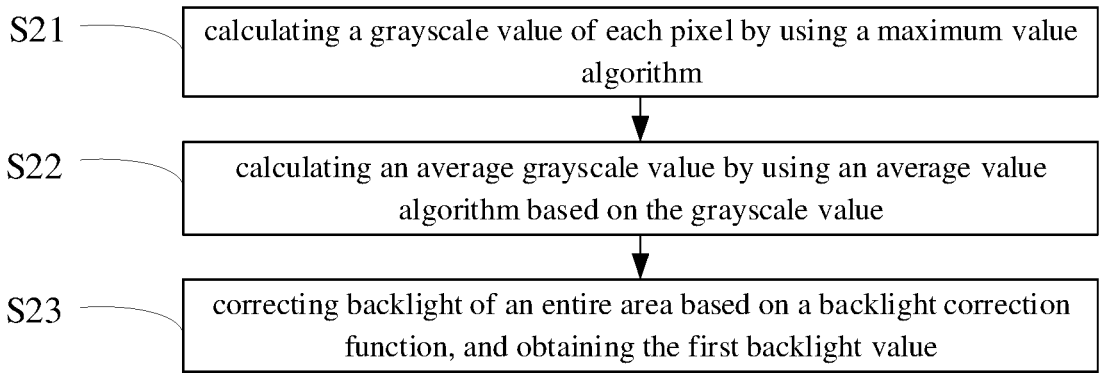
FIG. 3 is a schematic flowchart of a detailed process of the step of calculating a first backlight value based on the pixel point according to a second embodiment of the backlight control method of the present application.

Based on the first embodiment, a second embodiment of the backlight control method of the present application is provided. Referring to FIG. 3, in this embodiment, Step S20 includes:

Step S21: calculating a grayscale value of each pixel by using a maximum value algorithm;

Step S22: calculating an average grayscale value by using an average value algorithm based on the grayscale value; and Step S23: correcting backlight of an entire area based on a backlight correction function, and obtaining the first backlight value.

In this embodiment, the grayscale value refers to the color depth of a pixel point in a black and white image, which generally ranges from 0 to 255, white is 255, and black is 0. A maximum RGB value in all pixels is calculated by using a maximum value algorithm, the maximum RGB value is taken as a grayscale value of the pixel, and an average grayscale value is calculated by using an average value algorithm. Specifically, firstly a sum of corresponding grayscale values of all pixels is calculated, and then the sum of the grayscale values is divided by a number of pixels to obtain an average grayscale value. The first backlight value is calculated according to a formula set by a technician. The formula may be $BL'(i)=Local_{avg}+f(Local_{avg}, Local_{max})$, where BL'(i) is first backlight value, $Local_{avg}$ is average grayscale value, $Local_{max}$ is grayscale value of pixel, and $f(Local_{avg}, Local_{max})$ is backlight correction function. The backlight of the entire area is corrected by the backlight correction function. When $Local_{avg}$ is small, it means that the entire area is in a dark scene area, the brightness is small, and the correction value increases less. When $Local_{avg}$ is large, it means that the entire area is in the bright scene area, the brightness is large, and the correction value increases more.

In the backlight control method provided in this embodiment, the grayscale value of each pixel is calculated by using the maximum value algorithm, then the average grayscale value is calculated by using the average value algorithm based on the grayscale value, and finally the backlight of the entire area is corrected based on the backlight correction function to obtain the first backlight value. So that it is realized that the entire area is corrected by using the grayscale value and average grayscale value of the pixel, thereby obtaining the first backlight value.

Figure 4:
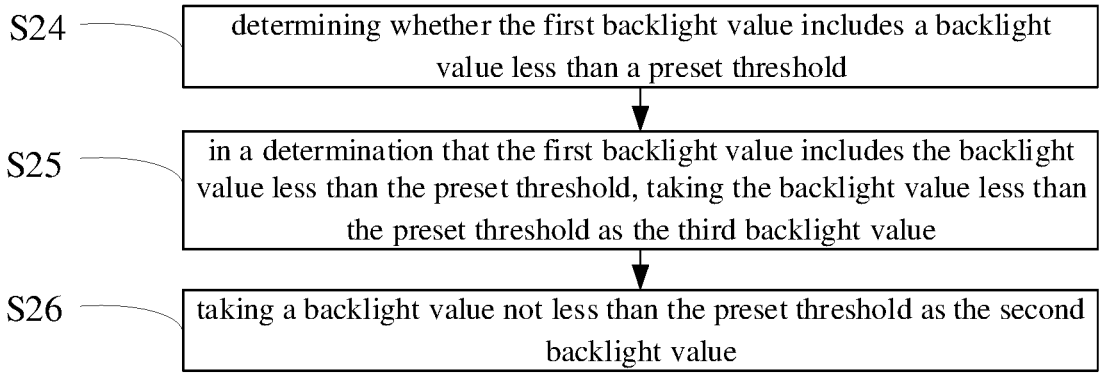
FIG. 4 is a schematic flowchart of a detailed process of the step of threshold-limiting the first backlight value, and obtaining a second backlight value subjected to threshold-limiting and a third backlight value without threshold-limiting according to a third embodiment of the backlight control method of the present application.

Based on the second embodiment, a third embodiment of the backlight control method of the present application is provided. Referring to FIG. 4, in this embodiment, Step S20 includes:

Step S24: determining whether the first backlight value includes a backlight value less than a preset threshold;

Step S25: in a determination that the first backlight value includes the backlight value less than the preset threshold, taking the backlight value less than the preset threshold as the third backlight value; and Step S26: taking a backlight value not less than the preset threshold as the second backlight value.

In this embodiment, the first backlight value is backlight-limited according to a set formula. The formula may be $BL(i)=\min(BL_{max}, BL'(i))$, where a preset threshold $BL_{max}$ is set, and the backlight value in the first backlight value is compared with the threshold $BL_{max}$ to determine whether there is a backlight value less than the preset threshold in the first backlight value, if there is a backlight value less than the preset threshold in the first backlight value, the backlight value less than the preset threshold is taken as the backlight value without threshold-limiting, and the backlight value not less than the preset threshold is taken as the backlight value subjected to threshold-limiting. Where the second backlight value is the backlight value subjected to threshold-limiting, and the third backlight value is the backlight value without threshold-limiting.

In the backlight control method provided in this embodiment, it is determined whether the first backlight value includes the backlight value less than the preset threshold, and then in a determination that the first backlight value includes the backlight value less than the preset threshold, the backlight value less than the preset threshold is taken as the third backlight value, and finally the backlight value not less than the preset threshold is taken as the second backlight value. So that the backlight limitation of the first backlight value is realized, thereby improving the image contrast, and ensuring the distortion of the image at the same time.

Figure 5:
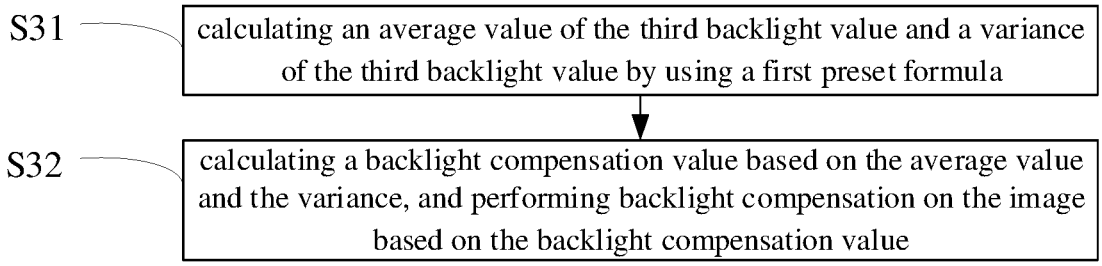
FIG. 5 is a schematic flowchart of a detailed process of the step of performing backlight compensation on the image based on the third backlight value according to a fourth embodiment of the backlight control method of the present application.

Based on the third embodiment, a fourth embodiment of the backlight control method of the present application is provided. Referring to FIG. 5, in this embodiment, Step S30 includes:

Step S31: calculating an average value of the third backlight value and a variance of the third backlight value by using a first preset formula; and Step S32: calculating a backlight compensation value based on the average value and the variance, and performing backlight compensation on the image based on the backlight compensation value.

In this embodiment, the backlight value subjected to threshold-limiting is sent to the backlight control circuit, and the backlight value without threshold-limiting is sent to the calculation module for calculating the corresponding backlight compensation value. Specifically, firstly the average value of the backlight value without threshold-limiting is calculated by using a formula $BL_{avg}=\Sigma_{i=1}^{N}BL'(i)$, and the variance of the backlight value without threshold-limiting is calculated by using the formula $BL_{var}=(\Sigma_{i=0}^{N}|BL'(i)-BLavg|)/(N-1)$. Where $BL_{avg}$ is average value of the backlight value without threshold-limiting, and $BL_{var}$ is variance of the backlight value without threshold-limiting. When obtaining the average value and the variance, the formula $BL_{com}(i)=f(BL(i), BL_{max-n})$, if $BL_{var}<T_{var}\cup BL_{avg}<T_{avg}$ is used, where $BL_{com}(i)$ is compensation value of the i-th area, BL(i) is the backlight value without threshold-limiting, $BL_{max-n}$ is maximum value of N backlight values without threshold-limiting in this area, $T_{var}$ is set preset variance threshold, and $T_{avg}$ is set preset average value threshold. The backlight compensation value is calculated according to the judgment condition, and an average value threshold and a variance threshold are set. If the calculated average value and variance meet the corresponding average value threshold and the variance threshold, then the backlight compensation value is calculated according to the formula, and backlight compensation is performed on the image according to the backlight compensation value. If the calculated average value and variance do not meet the corresponding average value threshold and variance threshold, the default backlight compensation value is 1, indicating that no backlight compensation is required.

In the backlight control method provided in this embodiment, the average value and the variance of the third backlight value is calculated by using the first preset formula, then the backlight compensation value is calculated based on the average value and the variance, and backlight compensation is performed on the image based on the backlight compensation value. So that backlight compensation is performed on the image, thereby improving contrast.

Figure 6:
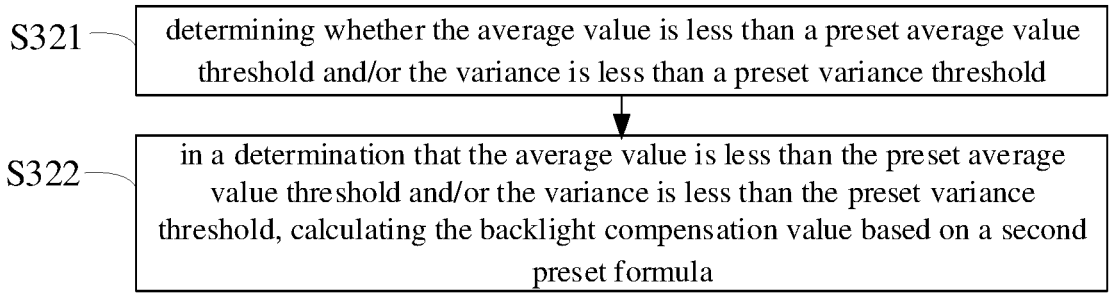
FIG. 6 is a schematic flowchart of a detailed process of the step of calculating a backlight compensation value based on the average value and the variance according to a fifth embodiment of the backlight control method of the present application.

Based on the fourth embodiment, a fifth embodiment of the backlight control method of the present application is provided. Referring to FIG. 6, in this embodiment, Step S32 includes:

Step S321: determining whether the average value is less than a preset average value threshold and/or the variance is less than a preset variance threshold; and Step S322: in a determination that the average value is less than the preset average value threshold and/or the variance is less than the preset variance threshold, calculating the backlight compensation value based on a second preset formula.

In this embodiment, the variance of the backlight value without threshold-limiting is calculated by using a formula $BL_{var}=(\Sigma_{i=0}^{N}|BL'(i)-BLavg|)/(N-1)$, where $BL_{avg}$ is average value of the backlight value without threshold-limiting, and $BL_{var}$ is variance of the backlight value without threshold-limiting. When the average value and the variance are obtained, the second formula is used:

$$BL_{com}(i)=f(BL(i),BL_{max-n}),\ \text{if}\ BL_{var}<T_{var}\cup BL_{avg}<T_{avg}$$

Where $BL_{com}(i)$ is compensation value of the i-th area, BL(i) is the backlight value without threshold-limiting, $BL_{max-n}$ is maximum value of N backlight values without threshold-limiting in this area, $T_{var}$ is set preset variance threshold, and $T_{avg}$ is set preset average value threshold. The backlight compensation value is calculated according to the judgment condition, and an average value threshold and a variance threshold are set. When the calculated average value is less than the preset average value threshold and/or the calculated variance is less than the preset variance threshold, the backlight compensation value is calculated according to the second formula.

In the backlight control method provided in this embodiment, it is determined whether the average value is less than the preset average value threshold and/or the variance is less than the preset variance threshold, and then in a determination that the average value is less than the preset average value threshold and/or the variance is less than the preset variance threshold, the backlight compensation value is calculated based on the second preset formula. In this way, the average value and the variance are judged, so that the backlight compensation value may be calculated correctly, thereby improving the contrast of the image.

Figure 7:
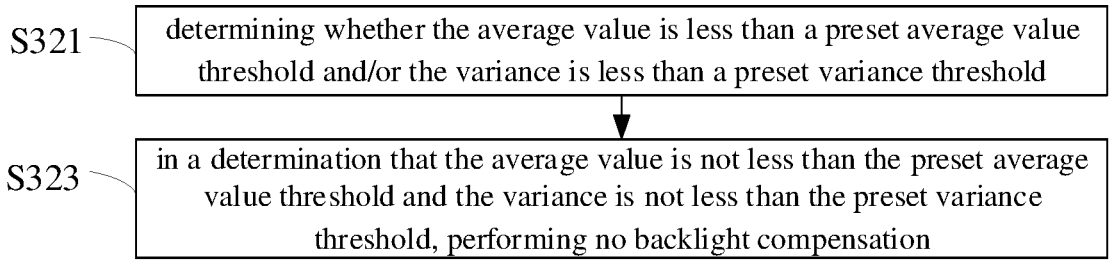
FIG. 7 is a schematic flowchart according to a sixth embodiment of the backlight control method of this application.

Based on the fifth embodiment, a sixth embodiment of the backlight control method of the present application is provided. Referring to FIG. 7, in this embodiment, subsequent to the Step S321, the backlight control method further includes:

Step S323: in a determination that the average value is not less than the preset average value threshold and the variance is not less than the preset variance threshold, performing no backlight compensation.

In this embodiment, in the fifth embodiment, if the average value is less than the preset average value threshold and/or the variance is less than the preset variance threshold, the backlight compensation value is calculated based on the second preset formula. If the average value is not less than the preset average value threshold and the variance is not less than the preset variance threshold, the default backlight compensation value is 1, indicating that no backlight compensation is performed on the image.

In the backlight control method provided in this embodiment, if the average value is not less than the preset average value threshold and the variance is not less than the preset variance threshold, no backlight compensation is performed.

In this way, the average value and the variance of the backlight value without threshold-limiting are judged, so as to determine whether backlight compensation is needed, thereby performing backlight compensation correctly for the image and improving the image contrast.

Figure 8:
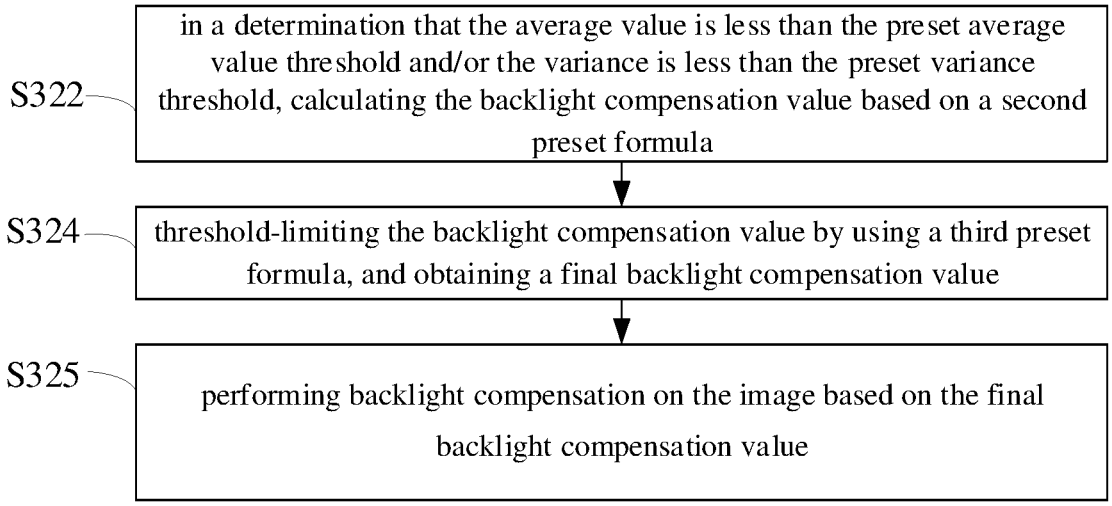
FIG. 8 is a schematic flowchart according to a seventh embodiment of the backlight control method of this application.

Based on the sixth embodiment, a seventh embodiment of the backlight control method of the present application is provided. Referring to FIG. 8, in this embodiment, subsequent to the Step S322, the backlight control method further includes:

Step S324: threshold-limiting the backlight compensation value by using a third preset formula, and obtaining a final backlight compensation value Step S325: performing backlight compensation on the image based on the final backlight compensation value.

In this embodiment, if the backlight value without threshold-limiting satisfies the second formula, it indicates that the current image area is a dark scene area, and the overall image is very dark. When a certain area has a very bright block, then the variance of this block is very large. According to the visual characteristics of the human eye, in this case, the image contrast will be stronger without affecting the human eye effect, so no light compensation is required. In order to prevent excessive light compensation, the technician may set a minimum threshold to perform threshold-limiting. The calculated backlight compensation value is subjected to threshold-limiting by using the third formula $BL'_{com}(i)=(T_{BL}, BL_{com}(i))$, so as to obtain the final backlight compensation value, and the image is subjected to backlight compensation according to the final backlight compensation value.

In the backlight control method provided in this embodiment, the backlight compensation value is subjected to threshold-limiting by using the third formula to obtain the final backlight compensation value, and then the image is subjected to backlight compensation according to the final backlight compensation value. In this way, threshold-limiting of the backlight compensation value is realized, avoiding excessive backlight compensation, thereby improving the image contrast and ensuring the distortion of the image.

Figure 9:
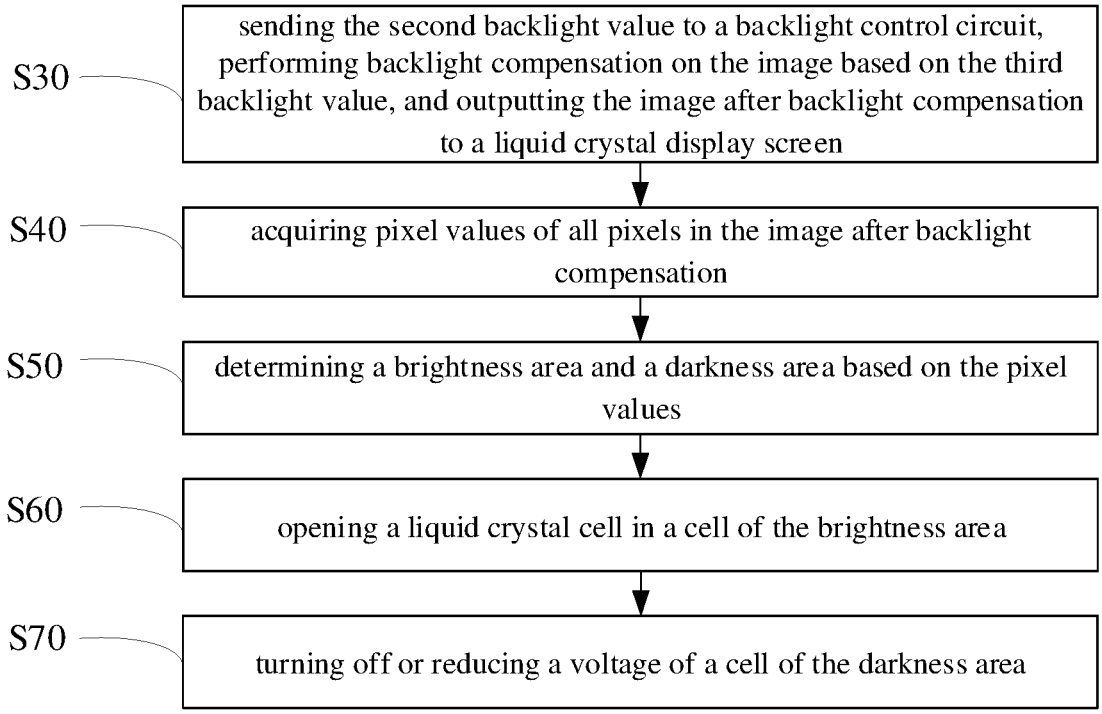
FIG. 9 is a schematic flowchart according to an eighth embodiment of the backlight control method of this application.

Based on the seventh embodiment, an eighth embodiment of the backlight control method of the present application is provided. Referring to FIG. 9, in this embodiment, subsequent to the Step S30, the backlight control method further includes:

Step S40: acquiring pixel values of all pixels in the image after backlight compensation;

Step S50: determining a brightness area and a darkness area based on the pixel values;

Step S60: opening a liquid crystal cell in a cell of the brightness area; and Step S70: turning off or reducing a voltage of a cell of the darkness area.

In this embodiment, the pixel values of all pixels in the image after backlight compensation are acquired, and the brightness area and the darkness area are determined according to the pixel values. Specifically, the pixel values of each area are determined whether the pixel value of each area is greater than a certain threshold, if the pixel value of a certain area is greater than a certain threshold, the area is a brightness area, and if the pixel value of a certain area is not greater than a certain threshold, the area is a dark area.

Further, when dividing the darkness area and the brightness area, the brightness of the brightness area is brighter, and the brightness of the darkness area is darker. The liquid crystal cell of the brightness area is turned on, and the liquid crystal cell in the darkness area with darker backlight is turned off, and at the same time, the voltage in the liquid crystal cell is turned off or reduced. In this way, light leakage is prevented while reducing power consumption.

In the backlight control method provided in this embodiment, the pixel values of all pixels in the image after backlight compensation are acquired, and then the brightness area and the darkness area are determined based on the pixel values, and then the liquid crystal cell in the cell of the brightness area is opened, and finally the voltage of the cell of the darkness area is turned off or reduced. So that debugging of the liquid crystal cell is realized, thereby reducing power consumption and preventing light leakage.

In addition, an embodiment of the present application further provides a computer-readable storage medium. The computer-readable storage medium of this application stores a backlight control program, the backlight control program, when executed by a processor, implements the following steps:

acquiring each pixel of each area in an image;

calculating a first backlight value based on the pixel, threshold-limiting the first backlight value, and obtaining a second backlight value subjected to threshold-limiting and a third backlight value without threshold-limiting; and sending the second backlight value to a backlight control circuit, performing backlight compensation on the image based on the third backlight value, and sending the image after backlight compensation to a liquid crystal display screen.

Further, the backlight control program, when executed by the processor, further implements the following steps:

calculating a grayscale value of each pixel by using a maximum value algorithm;

calculating an average grayscale value by using an average value algorithm based on the grayscale value; and correcting backlight of an entire area based on a backlight correction function, and obtaining the first backlight value.

Further, the backlight control program, when executed by the processor, further implements the following steps:

determining whether the first backlight value includes a backlight value less than a preset threshold;

in a determination that the first backlight value includes the backlight value less than the preset threshold, taking the backlight value less than the preset threshold as the third backlight value; and taking a backlight value not less than the preset threshold as the second backlight value.

Further, the backlight control program, when executed by the processor, further implements the following steps:

calculating an average value of the third backlight value and a variance of the third backlight value by using a first preset formula; and calculating a backlight compensation value based on the average value and the variance, and performing backlight compensation on the image based on the backlight compensation value.

Further, the backlight control program, when executed by the processor, further implements the following steps:

determining whether the average value is less than a preset average value threshold and/or the variance is less than a preset variance threshold; and in a determination that the average value is less than the preset average value threshold and/or the variance is less than the preset variance threshold, calculating the backlight compensation value based on a second preset formula.

Further, the backlight control program, when executed by the processor, further implements the following steps:

in a determination that the average value is not less than the preset average value threshold and the variance is not less than the preset variance threshold, performing no backlight compensation.

Further, the backlight control program, when executed by the processor, further implements the following steps:

threshold-limiting the backlight compensation value by using a third preset formula, and obtaining a final backlight compensation value; and performing backlight compensation on the image based on the final backlight compensation value.

Further, the backlight control program, when executed by the processor, further implements the following steps:

acquiring pixel values of all pixels in the image after backlight compensation;

determining a brightness area and a darkness area based on the pixel values;

opening a liquid crystal cell in a cell of the brightness area; and turning off or reducing a voltage of a cell of the darkness area.

It should be noted that in this article, the terms "comprise", "include" or any other variant thereof are intended to cover non-exclusive inclusion, so that a process, method, article or system that includes a series of elements includes not only those elements, but also other elements that are not explicitly listed, or include elements inherent to this process, method, article, or system. Without more restrictions, the element defined by the sentence "comprise a . . . " does not exclude that there are other identical elements in the process, method, article or system that includes the element.

The sequence numbers of the above embodiments of the present application are for description only, and do not represent the advantages and disadvantages of the embodiments.

Through the description of the above embodiments, those skilled in the art can clearly understand that the methods in the above embodiments can be implemented by means of software plus a necessary general hardware platform, and of course, can also be implemented by hardware, but in many cases the former is better. Based on this understanding, the technical solution of the present application can be embodied in the form of a software product in essence or part that contributes to the existing technology, and the computer software product is stored in a storage medium (such as ROM/RAM, Magnetic disk, optical disk as described above), including several instructions to make a terminal device (which can be a mobile phone, computer, server, air conditioner, or network equipment, etc.) to implement the method described in each embodiment of the present application.

The above are only preferred embodiments of the present application and do not limit the patent scope of the present application. Any equivalent structure or equivalent process transformation made by the description and drawings of the present application, or directly or indirectly used in other related technical fields are similarly included in the patent protection scope of the present application.

What is claimed is:

1. A backlight control method, comprising the following steps:

acquiring each pixel of each area in an image;

calculating first backlight values based on each pixel, threshold-limiting the first backlight values, to obtain a second backlight value subjected to threshold-limiting and a third backlight value without threshold-limiting; and sending the second backlight value to a backlight control circuit, performing backlight compensation on the image based on the third backlight value, and outputting the image after backlight compensation to a liquid crystal display screen;

wherein the step of calculating first backlight values based on each pixel comprises:

calculating a grayscale value of each pixel by using a maximum value algorithm;

calculating an average grayscale value by using an average value algorithm based on the grayscale value; and correcting backlight of an entire area based on a backlight correction function to obtain the first backlight values, a formula for calculating the first backlight values is as follows:

$BL'(i)=Local_{avg}+f(Local_{avg}, Local_{max})$, wherein BL'(i) is the first backlight values, $Local_{avg}$ is the average grayscale value by using the average value algorithm, $Local_{max}$ is the grayscale value of each pixel by using the maximum value algorithm, and $f(Local_{avg}, Local_{max})$ is the backlight correction function;

wherein the step of threshold-limiting the first backlight values, to obtain a second backlight value subjected to threshold-limiting and a third backlight value without threshold-limiting comprises:

determining whether the first backlight values comprise a backlight value less than a preset threshold;

in a determination that the first backlight values comprise the backlight value less than the preset threshold, taking the backlight value less than the preset threshold as the third backlight value; and taking a backlight value not less than the preset threshold as the second backlight value;

a formula for calculating the third backlight value is as follows:

$BL(i)=\min(BL_{max}, BL'(i))$, and $BL_{max}$ is the preset threshold.

2. The backlight control method according to claim 1, wherein the step of performing backlight compensation on the image based on the third backlight value comprises:

calculating an average value of the third backlight value and a variance of the third backlight value by using a first preset formula; and calculating a backlight compensation value based on the average value and the variance, and performing backlight compensation on the image based on the backlight compensation value.

3. The backlight control method of claim 2, wherein the step of calculating a backlight compensation value based on the average value and the variance comprises:

determining whether the average value is less than a preset average value threshold and/or the variance is less than a preset variance threshold; and in a determination that the average value is less than the preset average value threshold and/or the variance is less than the preset variance threshold, calculating the backlight compensation value based on a second preset formula.

4. The backlight control method according to claim 3, wherein subsequent to the step of determining whether the average value is less than a preset average value threshold and/or the variance is less than a preset variance threshold, the backlight control method further comprises:

in a determination that the average value is not less than the preset average value threshold and the variance is not less than the preset variance threshold, performing no backlight compensation.

5. The backlight control method according to claim 3, wherein subsequent to the step of in a determination that the average value is less than the preset average value threshold and/or the variance is less than the preset variance threshold, calculating the backlight compensation value based on a second preset formula, the backlight control method further comprises:

threshold-limiting the backlight compensation value by using a third preset formula, and obtaining a final backlight compensation value; and performing backlight compensation on the image based on the final backlight compensation value.

6. The backlight control method according to claim 5, wherein subsequent to the step of sending the second backlight value to a backlight control circuit, performing backlight compensation on the image based on the third backlight value, and sending the image after backlight compensation to a liquid crystal display screen, the backlight control method further comprises:

acquiring pixel values of all pixels in the image after backlight compensation;

determining a brightness area and a darkness area based on the pixel values;

opening a liquid crystal cell in a cell of the brightness area; and turning off or reducing a voltage of a cell of the darkness area.

7. A backlight control device, comprising: a memory, a processor, and a backlight control program stored on the memory and operable on the processor, the backlight control program, when executed by the processor, implements the following steps:

acquiring each pixel of each area in an image;

calculating first backlight values based on each pixel, threshold-limiting the first backlight values, to obtain a second backlight value subjected to threshold-limiting and a third backlight value without threshold-limiting; and sending the second backlight value to a backlight control circuit, performing backlight compensation on the image based on the third backlight value, and outputting the image after backlight compensation to a liquid crystal display screen;

wherein the step of calculating first backlight values based on each pixel comprises:

calculating a grayscale value of each pixel by using a maximum value algorithm;

calculating an average grayscale value by using an average value algorithm based on the grayscale value; and correcting backlight of an entire area based on a backlight correction function to obtain the first backlight values, a formula for calculating the first backlight values is as follows:

$BL'(i)=Local_{avg}+f(Local_{avg}, Local_{max})$, wherein BL'(i) is the first backlight values, $Local_{avg}$ is the average grayscale value by using the average value algorithm, $Local_{max}$ is the grayscale value of each pixel by using the maximum value algorithm, and f ($Local_{avg}$, $Local_{max}$) is the backlight correction function;

wherein the step of threshold-limiting the first backlight values, to obtain a second backlight value subjected to threshold-limiting and a third backlight value without threshold-limiting comprises:

determining whether the first backlight values comprise a backlight value less than a preset threshold;

in a determination that the first backlight values comprise the backlight value less than the preset threshold, taking the backlight value less than the preset threshold as the third backlight value; and taking a backlight value not less than the preset threshold as the second backlight value;

a formula for calculating the third backlight value is as follows:

$BL(i)=\min(BL_{max}, BL'(i))$, and $BL_{max}$ is the preset threshold.

8. The backlight control device according to claim 7, wherein the backlight control program, when executed by the processor, further implements the following steps:

calculating an average value of the third backlight value and a variance of the third backlight value by using a first preset formula; and calculating a backlight compensation value based on the average value and the variance, and performing backlight compensation on the image based on the backlight compensation value.

9. The backlight control device according to claim 8, wherein the backlight control program, when executed by the processor, further implements the following steps:

determining whether the average value is less than a preset average value threshold and/or the variance is less than a preset variance threshold; and in a determination that the average value is less than the preset average value threshold and/or the variance is less than the preset variance threshold, calculating the backlight compensation value based on a second preset formula.

10. The backlight control device according to claim 9, wherein the backlight control program, when executed by the processor, further implements the following steps:

in a determination that the average value is not less than the preset average value threshold and the variance is not less than the preset variance threshold, performing no backlight compensation.

11. The backlight control device according to claim 9, wherein the backlight control program, when executed by the processor, further implements the following steps:

threshold-limiting the backlight compensation value by using a third preset formula, and obtaining a final backlight compensation value; and performing backlight compensation on the image based on the final backlight compensation value.

12. The backlight control device according to claim 11, wherein the backlight control program, when executed by the processor, further implements the following steps:

acquiring pixel values of all pixels in the image after backlight compensation;

determining a brightness area and a darkness area based on the pixel values;

opening a liquid crystal cell in a cell of the brightness area; and turning off or reducing a voltage of a cell of the darkness area.

13. A non-transitory computer-readable storage medium, wherein a backlight control program is stored on the non-transitory computer-readable storage medium, the backlight control program, when executed by a processor, implements the following steps:

acquiring each pixel of each area in an image;

calculating first backlight values based on each pixel, threshold-limiting the first backlight values, to obtain a second backlight value subjected to threshold-limiting and a third backlight value without threshold-limiting; and sending the second backlight value to a backlight control circuit, performing backlight compensation on the image based on the third backlight value, and outputting the image after backlight compensation to a liquid crystal display screen;

wherein the step of calculating first backlight values based on the pixel comprises:

calculating a grayscale value of each pixel by using a maximum value algorithm;

calculating an average grayscale value by using an average value algorithm based on the grayscale value; and correcting backlight of an entire area based on a backlight correction function to obtain the first backlight values, a formula for calculating the first backlight values is as follows:

$BL'(i)=Local_{avg}+f(Local_{avg}, Local_{max})$, wherein $BL'(i)$ is the first backlight values, $Local_{avg}$ is the average grayscale value by using the average value algorithm, $Local_{max}$ is the grayscale value of each pixel by using the maximum value algorithm, and $f(Local_{avg}, Local_{max})$ is the backlight correction function;

wherein the step of threshold-limiting the first backlight values, to obtain a second backlight value subjected to threshold-limiting and a third backlight value without threshold-limiting comprises:

determining whether the first backlight values comprise a backlight value less than a preset threshold;

in a determination that the first backlight values comprise the backlight value less than the preset threshold, taking the backlight value less than the preset threshold as the third backlight value; and taking a backlight value not less than the preset threshold as the second backlight value;

a formula for calculating the third backlight value is as follows:

$BL(i)=\min(BL_{max}, BL'(i))$, and $BL_{max}$ is the preset threshold.

14. The computer-readable storage medium of claim 13, wherein the backlight control program, when executed by the processor, further implements the following steps:

calculating an average value of the third backlight value and a variance of the third backlight value by using a first preset formula; and calculating a backlight compensation value based on the average value and the variance, and performing backlight compensation on the image based on the backlight compensation value.

* * * * *